US009890756B2

(12) United States Patent
Sundemo et al.

(10) Patent No.: US 9,890,756 B2
(45) Date of Patent: Feb. 13, 2018

(54) HEAT STORAGE IN ENGINE COOLING SYSTEM

(71) Applicant: VOLVO CAR CORPORATION, Gothenburg (SE)

(72) Inventors: Stefan Mats Sundemo, Angered (SE); Kaj Johansson, Molndal (SE); John Nilsson, Vastra Frolunda (SE); Rikard Rigdal, Molndal (SE); Bengt Salekarr, Karna (SE)

(73) Assignee: Volvo Car Corporation, Gothenburg (SE)

( * ) Notice: Subject to any disclaimer, the term of this patent is extended or adjusted under 35 U.S.C. 154(b) by 262 days.

(21) Appl. No.: 14/534,239

(22) Filed: Nov. 6, 2014

(65) Prior Publication Data

US 2015/0136048 A1 May 21, 2015

(30) Foreign Application Priority Data

Nov. 15, 2013 (EP) ..... 13193124

(51) Int. Cl.
*F01P 11/20* (2006.01)
*F02N 19/10* (2010.01)
*F01P 7/16* (2006.01)

(52) U.S. Cl.
CPC ..... *F02N 19/10* (2013.01); *F01P 7/16* (2013.01); *F01P 7/165* (2013.01); *F01P 11/20* (2013.01); *F01P 2011/205* (2013.01)

(58) Field of Classification Search
CPC ... F02N 19/10; F01P 7/16; F01P 7/165; F01P 11/20
See application file for complete search history.

(56) References Cited

U.S. PATENT DOCUMENTS 7,216,697 B2 5/2007 Odeskog et al.
2006/0231640 A1* 10/2006 Hashimura ..... B60H 1/00492 237/34

(Continued)

FOREIGN PATENT DOCUMENTS

DE 102011050200 A1 * 11/2012 ..... F28D 20/00
FR 2843168 A1 2/2004

(Continued)

OTHER PUBLICATIONS

Extended European Search Report dated Mar. 18, 2014, Application No. 13193124.8-1603, Applicant Volvo Car Corporation, 7 Pages.

*Primary Examiner* — Kevin A Lathers
(74) *Attorney, Agent, or Firm* — Brooks Kushman P.C.

(57) ABSTRACT

A heating and cooling system for an internal combustion engine comprising a heat storage circuit and a radiator circuit, and a method of controlling such a system are disclosed. The heat storage circuit comprises a heat storage container in which engine coolant is stored and allowed to flow into and out of. The radiator circuit comprises a radiator for flow of the engine coolant, and the radiator has a radiator inlet connected via an upstream radiator conduit to a coolant outlet of the engine, and a radiator outlet connected via a downstream radiator conduit to a coolant inlet of the engine. A bypass conduit is connected between the upstream radiator conduit and the downstream radiator conduit to allow coolant to bypass the radiator. A thermostat controlled valve is arranged in the upstream radiator conduit at a coolant outlet of the engine and connected to the bypass conduit.

18 Claims, 6 Drawing Sheets

(56) References Cited

U.S. PATENT DOCUMENTS

| | | | | |
|---|---|---|---|---|
| 2008/0216777 | A1* | 9/2008 | Vetrovec | F01P 11/20 123/41.29 |
| 2010/0186685 | A1 | 7/2010 | Hiyama | |
| 2014/0097261 | A1* | 4/2014 | Blumenstock | B60H 1/00492 237/5 |

FOREIGN PATENT DOCUMENTS

| | | | | |
|---|---|---|---|---|
| JP | 10159564 | A | | 6/1998 |
| JP | 2000073764 | A | | 3/2000 |
| JP | 2003184556 | A | * | 7/2003 |
| JP | 2004301063 | A | | 10/2004 |

* cited by examiner

HEAT STORAGE IN ENGINE COOLING SYSTEM

CROSS-REFERENCE TO RELATED APPLICATIONS

This application claims foreign priority benefits under 35 U.S.C. § 119(a)-(d) to European patent application number EP 13193124.8, filed Nov. 15, 2013 which is incorporated by reference in its entirety.

TECHNICAL FIELD

The present disclosure relates to a heating and cooling system for an internal combustion engine and a method of controlling such a system.

BACKGROUND

Today, there exist differently configured and types of cooling systems for internal combustion engines in vehicles comprising heat storage accumulators or containers to be utilized for warm-up of the engine after an engine stop. Such heat storage containers are used by being charged with hot coolant during engine running, which containers then are emptied by discharging and circulating the stored hot coolant in the engine during start-up for warming up the engine.

One example of such a heat storage system is disclosed in US 2010/0186685 A1.

However, the constant increasing demand on lowering unwanted exhaust emission and fuel consumption characteristics of internal combustion engines at cold start has revealed that warm-up of the engine after an engine stop is still not satisfactory by using prior art heat storage systems.

SUMMARY

One object of the present disclosure is to overcome at least some of the problems and drawbacks mentioned above.

These and further objects are achieved by a heating and cooling system for an internal combustion engine comprising a heat storage circuit and a radiator circuit, wherein the heat storage circuit comprises a heat storage container, in which engine coolant is stored and allowed to flow into and out of, which heat storage container has a container inlet connected, e.g., via a container conduit, to a first coolant outlet of the engine and a container outlet connected, e.g., via a container conduit, to a first coolant inlet of the engine. The radiator circuit comprises a radiator for flow of the engine coolant and the radiator has an radiator inlet and an radiator outlet, the radiator inlet being connected, e.g., via an upstream radiator conduit, to a second coolant outlet of the engine and the radiator outlet being connected, e.g., via a downstream radiator conduit, to a second coolant inlet of the engine. A bypass conduit is connected between the upstream radiator conduit and the downstream radiator conduit and adapted to allow coolant to bypass the radiator; and a thermostat controlled valve arranged in the upstream radiator conduit at the second coolant outlet and connected to the bypass conduit, which thermostat controlled valve is adapted to direct coolant flow to the radiator and/or to the bypass conduit, wherein a shut-off valve is arranged in the bypass conduit.

These and further objects are also achieved by a method of controlling the heating and cooling system above comprising a heat storage circuit and a radiator circuit, which heat storage circuit comprises a heat storage container storing engine coolant and allowing coolant to flow into and out of, and which heat storage container has a container inlet connected, e.g., via a container conduit, to a first coolant outlet of the engine and a container outlet connected, e.g., via a container conduit, to a first coolant inlet of the engine. The radiator circuit comprises a radiator for flow of the engine coolant and the radiator has an radiator inlet and an radiator outlet, the radiator inlet being connected, e.g., via an upstream radiator conduit, to a second coolant outlet of the engine and the radiator outlet being connected, e.g., via a downstream radiator conduit, to a second coolant inlet of the engine. A bypass conduit is connected between the upstream radiator conduit and the downstream radiator conduit allowing coolant to bypass the radiator; and a thermostat controlled valve is arranged in the upstream radiator conduit at the second coolant outlet and connected to the bypass conduit, which thermostat controlled valve directs coolant flow to the radiator and/or to the bypass conduit, by a shut-off valve being arranged in the bypass conduit for controlling any engine coolant flow through the bypass conduit and the thermostat controlled valve.

In some embodiments, the shut-off valve is adapted to cut off any engine coolant flow through the bypass conduit until the heat storage container is recharged with engine coolant of a predetermined temperature.

In some embodiments, the shut-off valve is adapted to open for engine coolant flow through the bypass conduit such that the thermostat controlled valve is opened when the engine coolant has a temperature being equal to or greater than a predetermined temperature.

In some embodiments, the shut-off valve is adapted to cut off any engine coolant flow through the bypass conduit until the predetermined charge temperature of the heat storage container is reached, this temperature being higher than the opening temperature of the thermostat controlled valve.

In some embodiments, the shut-off valve is adapted to cut off any engine coolant flow through the bypass conduit until the predetermined charge (or target) temperature of the heat storage container is stable/reached.

In some embodiments, an intermediate conduit is connected between the heat storage circuit and the radiator circuit and a second shut-off valve is arranged in the intermediate conduit.

In some embodiments, the second shut-off valve is adapted to cut off any engine coolant flow from an oil cooler of the engine to the radiator circuit until the heat storage container is recharged with engine coolant of a predetermined temperature being higher than the opening temperature of the thermostat controlled valve.

In some embodiments, the second shut-off valve is adapted to cut off any engine coolant flow from an oil cooler of the engine to the radiator circuit until the engine coolant has a temperature being equal to or greater than the predetermined temperature.

In some embodiments, a method of controlling a heating and cooling system is achieved by the shut-off valve cutting off any engine coolant flow through the bypass conduit until the heat storage container is recharged with engine coolant of a predetermined temperature being higher than the opening temperature of the thermostat controlled valve.

In some embodiments, the method of controlling a heating and cooling system is achieved by the shut-off valve opening for engine coolant flow through the bypass conduit, such that the thermostat controlled valve opens, when the engine coolant has reached a temperature being equal to or greater than the opening temperature of the thermostat controlled valve.

In some embodiments, the method of controlling a heating and cooling system is achieved by the shut-off valve cutting off any engine coolant flow through the bypass conduit until the predetermined charge temperature of the heat storage container is reached, this temperature being higher than the opening temperature of the thermostat controlled valve.

The effects and advantages of the above system; the method of controlling said system, and the embodiments are the following. It is possible to reach a significantly higher temperature for charging a thermos, i.e., a heat storage container, this temperature being higher than the opening temperature of the thermostat controlled valve, by preventing the hot coolant to reach the thermostat in the radiator system by restricting the flow in the thermostat area, i.e., around the thermostat during start- and warm-up of the engine. According to the disclosure, the shut-off valve cuts off any engine coolant flow through the bypass conduit until at least a control valve for the heat storage container is closed. After this closure, i.e., stopping the flow of hot coolant into and out of the hot storage container, after having reached a predetermined temperature in the heat storage container being higher than the opening temperature of the thermostat controlled valve, it is possible to store more heat energy into a specific volume/weight of a heat storage container than hitherto possible, and to improve the time from the container, i.e., thermos charge until heat is no longer available, typically 24 hours prolongation compared to prior art systems.

According to the disclosure, the idea is to use a heat storage container in the system, and get the most energy out of the space occupied by the container as packaging space is scarce in today's modern vehicles, i.e., the size of any heat storage container is impossible to increase, at least not to a large extent or in a more cost efficient way. Hence, when charging a heat storage container in the inventive cooling system we can get the highest possible temperature of the coolant into the container before the thermostat opens for coolant flow into the larger radiator system of the vehicle. The inventors realized, as the size of the coolant storage container or thermos is in principle fixed, that the temperature in the coolant storage thermos determines the amount of stored energy, the higher the temperature, the higher the amount of stored heat to improve emissions and fuel consumption at the next engine start.

Existing systems charge a heat storage container, i.e., the coolant storage thermos, at a temperature lower than thermostat opening temperature, typically 85° C. (if thermostat opening starts at 90° C.). By increasing the charge temperature into the heat storage container to above, i.e., higher than the opening temperature of the thermostat controlled valve according to the disclosure, the stored energy is increased from, one example is (85−20=ΔT, degree Celsius/Kelvin)* (times) m (mass, kg)*(times) cp (specific heat capacity, J/kg*K) to (110−20=ΔT)*m*cp if the ambient temperature is about 20° C., meaning an improvement of almost 40% and higher using the same weight and volume for the container. This also leads to reduced fuel consumption, less exhaust emissions, specifically Hydrocarbons (HC) and carbon monoxides (CO) for diesel engines.

BRIEF DESCRIPTION OF THE DRAWINGS

The disclosure will be described in more detail with reference to the accompanying drawings.

DETAILED DESCRIPTION

Figure 1:
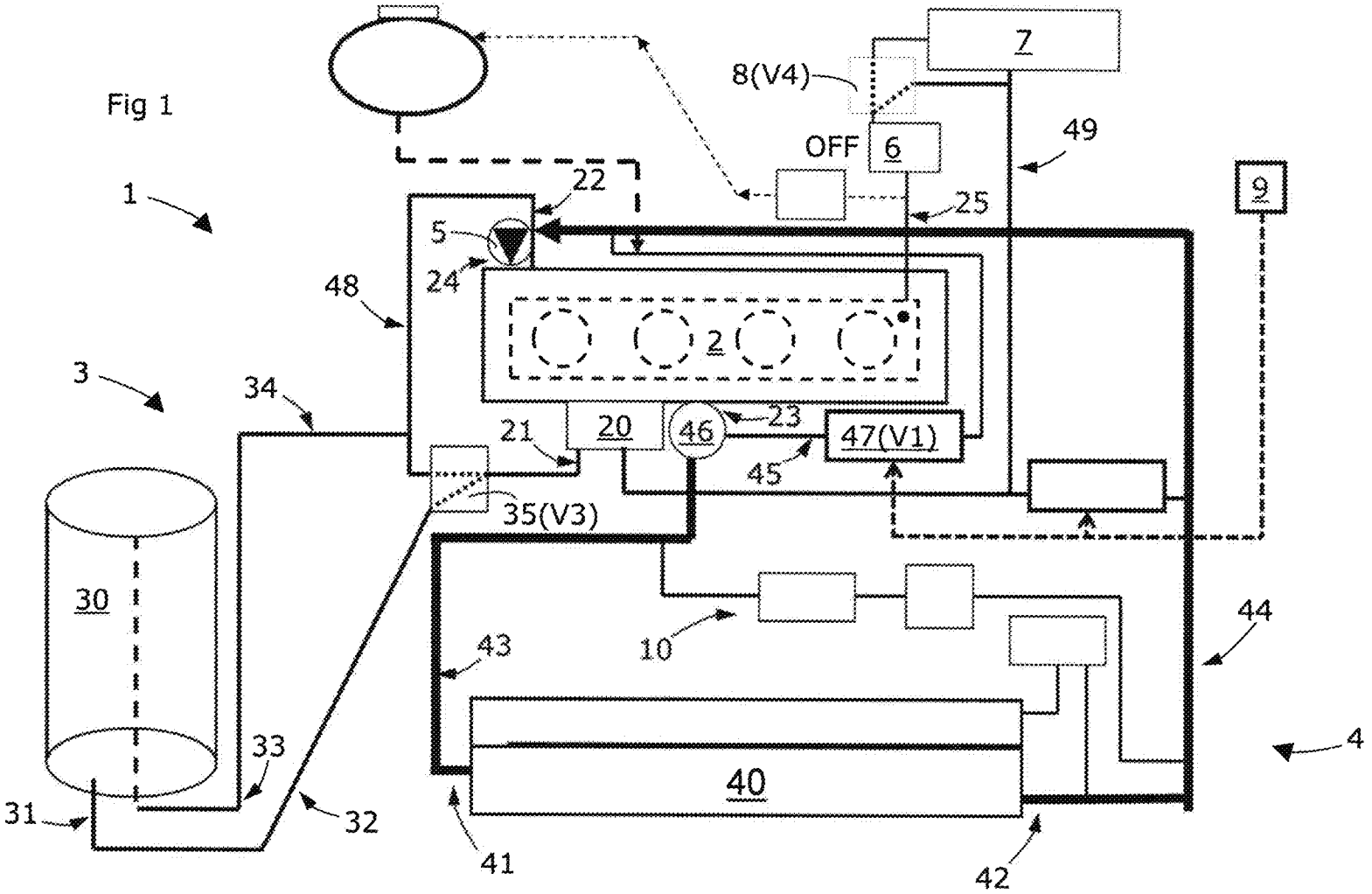
FIG. 1 shows a heating and cooling system of the disclosure before cold start of an engine, i.e., during a stop of the engine when a heat storage container of a heat storage circuit has been charged with hot coolant for storage thereof.

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

As described above and shown in FIGS. 1 to 6, the present disclosure relates to a heating and cooling system 1 for an internal combustion engine 2, which engine may be either a petrol/gasoline or diesel engine. The arrows of the FIGS. 1 to 5 show the small flow paths of the coolant in a heat storage circuit 3 during the warm-up of the engine 2 according to the disclosure in FIGS. 1 to 5, while FIG. 6 shows the full coolant flow also through a larger radiator system 4, i.e., the radiator system for "normal" cooling of the engine 2 during normal operation of the engine and normal driving of the vehicle.

The heating and cooling system 1 comprises the inventive heat storage circuit 3 and the large radiator circuit 4. The heat storage circuit 3 comprises a heat storage container 30, in which engine coolant is stored and allowed to flow into and out of. The heat storage container 30 has a container inlet 31 connected via a container conduit 32 to a first coolant outlet 21 of the engine and a container outlet 33 connected via a container conduit 34 to a first coolant inlet 22 of the engine. The radiator circuit 4 comprises a radiator 40 for flow of the engine coolant and the radiator has a radiator inlet 41 and a radiator outlet 42. The radiator inlet 41 is connected via an upstream radiator conduit 43 to a second coolant outlet 23 of the engine 2. The radiator outlet 42 is connected via a downstream radiator conduit 44 to a second coolant inlet 24 of the engine 2.

The heating and cooling system 1 comprises a bypass conduit 45 connected between the upstream radiator conduit 43 and the downstream radiator conduit 44. This bypass conduit 45 is adapted to allow coolant to bypass the radiator 40. A thermostat controlled valve 46 is arranged in the upstream radiator conduit 43 at the second coolant outlet 23. The thermostat controlled valve 46 is connected to the bypass conduit 45. The thermostat controlled valve 46 is adapted to direct coolant flow to the radiator 40 and/or to the bypass conduit. According to the disclosure, a shut-off valve 47 is arranged in the bypass conduit 45.

The heating and cooling system 1 may comprise an electric vacuum switch system 9 for control of the shut-off valve 47 (V1) and the control lines are shown dashed with arrows but only represent electrical signal lines and not any flow path for the coolant. This is a known way of control and will not be explained in further detail.

The heating and cooling system 1 may comprise a degas system comprising an expansion tank for compensation of volume change of the coolant and associated equipment, such as conduits and valves for letting out and guiding back any steam from the coolant into the system 1 in a known way and will not be explained in further detail.

The engine 2 as shown in FIGS. 1 to 5 may also comprise an exhaust gas recirculation cooling system 10 (EGR cooling system, FIG. 1) comprising an electrical water pump, and an exhaust gas recirculation cooler and associated means, such as conduits and valves between the upstream radiator conduit 43 and the downstream radiator conduit 44. The engine may comprise a transmission oil cooler (TOC) connected to the radiator 40. The EGR cooling system and TOC will not be explained further as they are common knowledge for skilled persons.

The heat storage circuit 3 is adapted to separately from the radiator circuit 4 circulate coolant for a quicker warm-up of the engine 2 after a stop of the engine according to the disclosure. In principle, the heat storage circuit 3 circulates a lesser amount/volume of coolant compared to the radiator circuit 4, but as the temperature for the coolant stored in the heat storage container 30 is higher than any opening temperature of the thermostat controlled valve 46, this temperature is high enough for achieving a quicker warm-up of the engine compared to prior art even though the size of the heat storage container in fact is not increased, i.e., at least not increased substantially in size, according to the disclosure. In any case, when the flow in the radiator circuit 4 is initiated, started or ongoing as shown in FIG. 6 (no such radiator flow is shown in FIGS. 1 to 5 as the charging of the heat storage container 30 is performed according to the disclosure separately from the "normal"/large flow of coolant in the radiator while not letting any thermostat controlled valve open for enabling any radiator flow or any bypass flow, respectively.

In one embodiment, the heat storage container 30 has its container inlet 31 connected via a container conduit 32 to one of two outlet ports of a three-way valve 35 (V3, see FIGS. 1 to 5). The three-way valve 35 is in turn connected with its inlet port to the first coolant outlet 21 of the engine 2. The heat storage container outlet 33 is connected via the container conduit 34 to the first coolant inlet 22 of the engine 2 via a re-circulation conduit 48 between said inlet 22 and the other one of the two outlet ports of the three-way valve 35. The re-circulation conduit 48 enables for coolant that flows from the first coolant outlet 21 of the engine 2 to the inlet port of the three-way valve 35 and through the three-way valve 35 to enter the first coolant inlet 22 of the engine 2.

The first coolant outlet 21 of the engine 2 may let coolant flow out of an engine oil cooler 20 (EOC) if the vehicle is equipped with such an EOC, e.g., if the vehicle uses an automatic transmission that must be cooled during performance driving conditions. Coolant flow, in general, is substantially a function of water pump speed.

The heat storage circuit 3 and coolant flow through it is controlled and achieved by means of a first electrical coolant pump 6 (see upper part of FIGS. 1 to 6). This first electrical coolant pump 6 has its inlet connected to a third coolant outlet 25 of the engine 2. The first electrical coolant pump 6 has its outlet connected to an inlet port of a second three-way valve 8 (V4) (see upper part of FIGS. 1 to 6). This three-way valve 8 controls heating of a cabin of the vehicle if requested/desired. This is done in that the second three-way valve 8 may be connected to a cabin heater 7 and a cabin circulation conduit 49, and the cabin heater may be connected to the cabin circulation conduit 49. The radiator circuit 4 comprises a water pump 5 connected to the second coolant inlet 24 to be able to pump coolant through the radiator circuit when needed, i.e., when the coolant has reached a temperature after warm-up of the engine 2 being higher than a predetermined one. This temperature is monitored and is an opening temperature for the thermostat controlled valve 46 being arranged in the upstream radiator conduit 43 at the second engine coolant outlet 23.

The second coolant inlet 24 of the engine 2 is placed at the opposite side of the engine compared to the first engine coolant outlet 21 and the second engine coolant outlet 23. The bypass conduit 45 is connected between the upstream radiator conduit 43 and the downstream radiator conduit 44. The thermostat controlled valve 46 is connected to the bypass conduit 45.

Hence, the shut-off valve 47 is adapted to cut off any engine coolant flow through the thermostat controlled valve 46. This is done by means of the shut-off valve 47 being arranged in the bypass conduit 45 enabling that no engine coolant is able to flow past or be in any heating contact with the thermostat controlled valve 46, such that the heat of the engine coolant is not transferred to the thermostat controlled valve 46. Hence, the thermostat controlled valve 46 is not opened and does not let any engine coolant flow through the radiator when the bypass conduit 45 is closed off by the shut-off valve 47 according to the disclosure.

The thermostat controlled valve 46 opens when the temperature of the coolant is equal to and/or higher than its opening temperature by means of wax expanding at a heat sensing portion of the thermostat 46. According to the disclosure, by placing the shut-off valve 47 in the bypass conduit 45, this shut-off valve 47 is used to control how much heat the heat sensing portion of the thermostat controlled valve 46 is exposed to by controlling how much flow of hot coolant that is let through the bypass conduit 45. This control is enabled as such an arrangement of the shutoff valve 47 directly controls the amount of hot coolant through a thermostat housing of the thermostat controlled valve 46. No flow of hot coolant through the bypass conduit and the thermostat housing of the thermostat controlled valve 46 by shutting off bypass conduit 45 completely by shut-off valve 47, means that substantially no heat is transferred to the heat sensing portion of the thermostat controlled valve 46 and no expansion of wax occurs and hence no opening of the thermostat controlled valve is achieved. A small or larger amount of flow of hot coolant let through the bypass conduit 45 and the thermostat housing of the thermostat controlled valve 46 by only opening the shutoff valve 47 somewhat or partly, means that more or less heat is transferred to the heat sensing portion of the thermostat controlled valve 46 and expansion of wax occurs for opening the thermostat controlled valve. This control is done to achieve as high a coolant temperature as possible for use as the highest possible charging temperature of the heat storage container 30 before the larger radiator circuit 4 and its "normal" cooling of coolant is required and initiated.

The shut-off valve 47 cuts off any engine coolant flow through the bypass conduit 45 until the heat storage container 30 is recharged with engine coolant of a predetermined temperature. In another embodiment, the shut-off valve 47 opens for engine coolant flow through the bypass conduit 45, so that the thermostat controlled valve 46 is opened, when the engine coolant has a temperature being equal to or greater than a predetermined temperature, this temperature being higher than the opening temperature of the thermostat controlled valve 46.

The shut-off valve 47 cuts off any engine coolant flow through the bypass conduit 45 until at least the control valve 35 for the heat storage container 30 is closed. This closure ends the hot coolant flow into and out of the heat storage container 30 (see FIGS. 5 and 6).

The heating and cooling system 1 may also comprise an intermediate conduit connected between the heat storage circuit 3 and the radiator circuit 4. A second shut-off valve may be arranged in the intermediate conduit between the engine oil cooler 20 and the downstream radiator conduit 44 in the Figures.

An inventive control of the heating and cooling system 1 comprising the heat storage circuit 3 and the radiator circuit 4 is achieved. This inventive method is realized by arranging the shut-off valve 47 in the bypass conduit 45 for controlling any engine coolant flow through the bypass conduit 45 and the thermostat controlled valve 46 before the large coolant flow through the radiator circuit 4 is initiated.

FIG. 1 shows the heating and cooling system 1 according to the disclosure before any cold start for warm-up of the engine 2. All components, conduits and fluids are cold except coolant that has "charged" into the heat storage container 30 working as a thermos with hot fluid, i.e., hot coolant. There is not yet any flow of coolant in any of the circuits 3 and 4 of the heating and cooling system 1, i.e., FIG. 1 shows a passive storage scenario.

Figure 2:
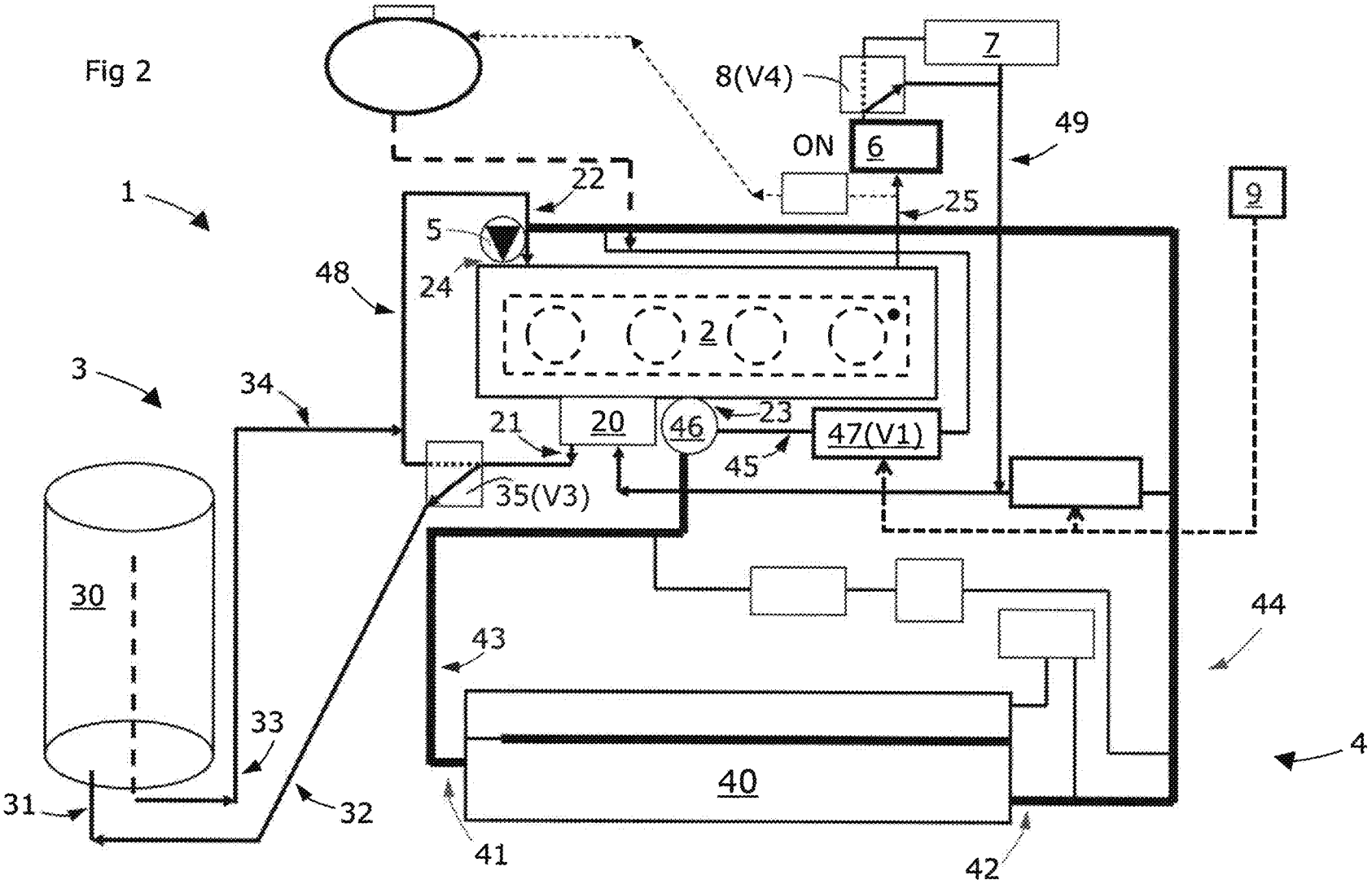
FIG. 2 shows the heating and cooling system of FIG. 1 at start of the engine for beginning a warm up of the engine at high ambient temperature by starting to discharge and circulate hot coolant from the heat storage container in the engine until no further stored and useful energy is available in the heat storage container.

FIG. 2 shows a start scenario of the warm-up procedure of the "cold" engine 2 in FIG. 1. The engine is started. The first three-way valve 35 is opened. The first electrical coolant pump 6 is started to circulate coolant from the heat storage container 30 working as a thermos in an inventive small inner circuit, i.e. the heat storage circuit 3. Coolant flow from main coolant, i.e., water pump 5 is blocked with shutoff valve 47. Block and head water jacket of the engine 2 is heated as long as the temperature in the heat storage container 30 is higher than coolant or water temperature into the heat storage container 30 until no further stored energy is available in the heat storage container. This scenario has duration less than 1 minute (duration<1 minute).

Figure 3:
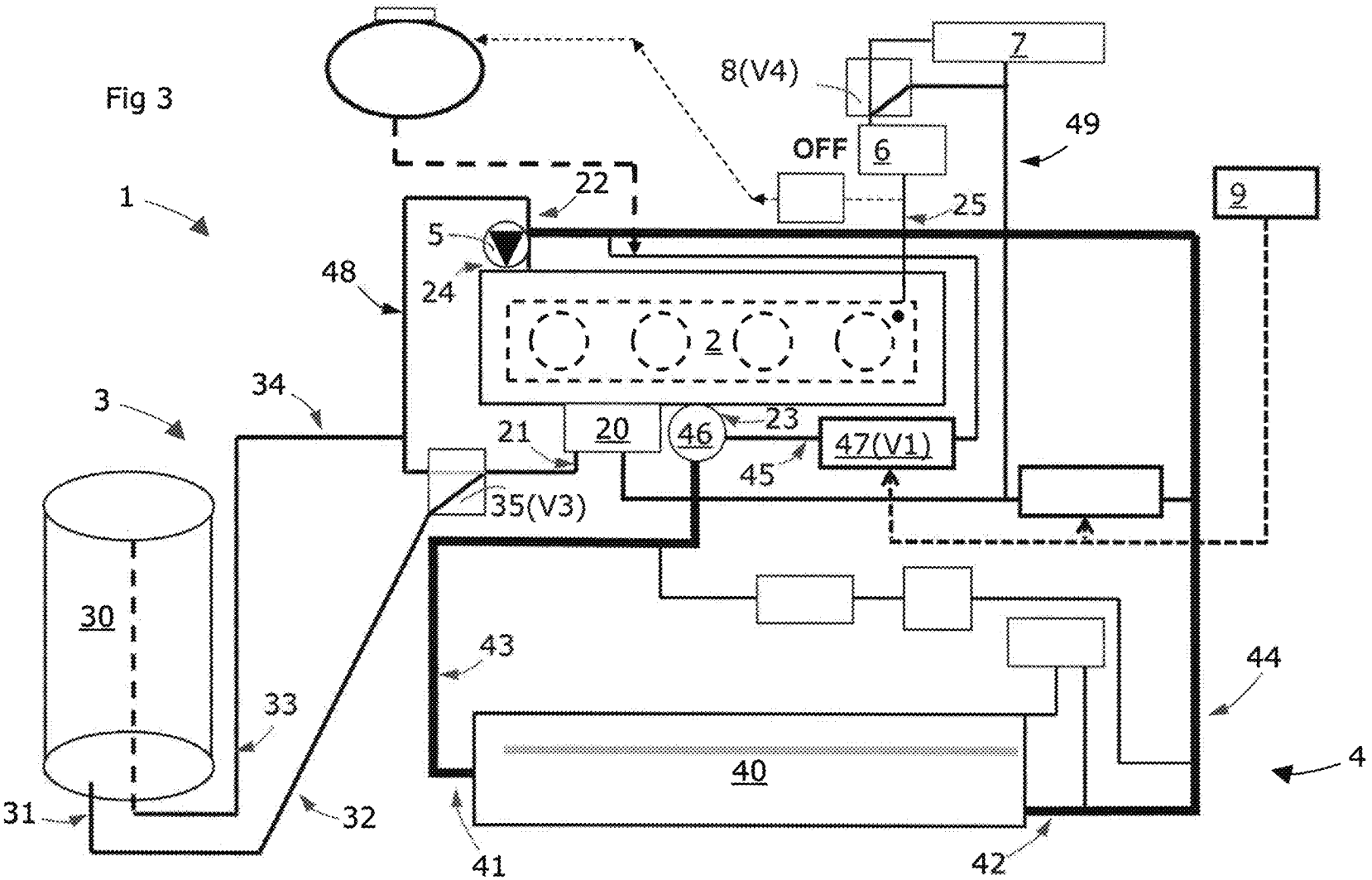
FIG. 3 shows the heating and cooling system of FIGS. 1 and 2 during continued warm up of the engine by heat rejection from combustion with no circulation of coolant during this stage.

FIG. 3 shows a subsequent scenario of the warm-up procedure of the engine 2 in FIGS. 1 and 2. The first three-way valve 35 is closed. The first electrical coolant pump 6 is stopped. The engine 2 continues to warm up with heat from continued combustion. Coolant flow from main coolant/water pump 5 is still blocked with shutoff valve 47.

Figure 4:
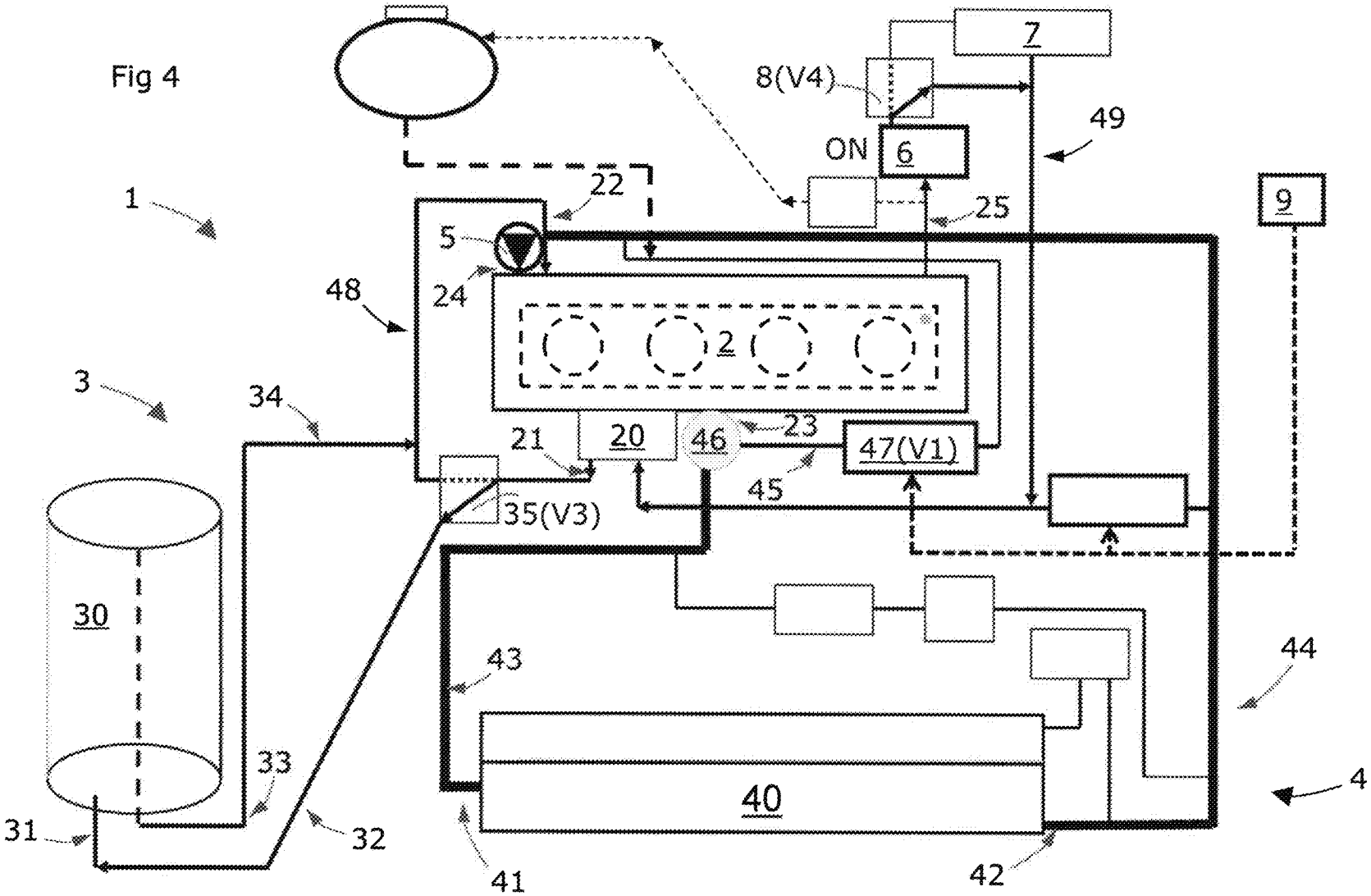
FIG. 4 shows the heating and cooling system of FIGS. 1 to 3 when the coolant in the system has reached a predetermined value for start of charging the heat storage container, wherein charging of the heat storage container has started and will continue until target temperature for the heat storage container is stable and charging of the heat storage container will then stop.

FIG. 4 shows a subsequent scenario of the warm-up procedure of the engine 2 in FIGS. 1, 2 and 3. The target temperature for recharge of the heat storage container 30 is reached. The first three-way valve 35 is again opened. The first electrical coolant pump 6 is started to circulate coolant to the heat storage container 30 in the small inner circuit, i.e., the heat storage circuit 3. Coolant flow from main coolant/water pump 5 is still blocked with shutoff valve 47. This condition in FIG. 4 continues until the charge temperature is stable, i.e. until the charge temperature is equal or higher than the target temperature (charge temperature=>target temperature).

Figure 5:
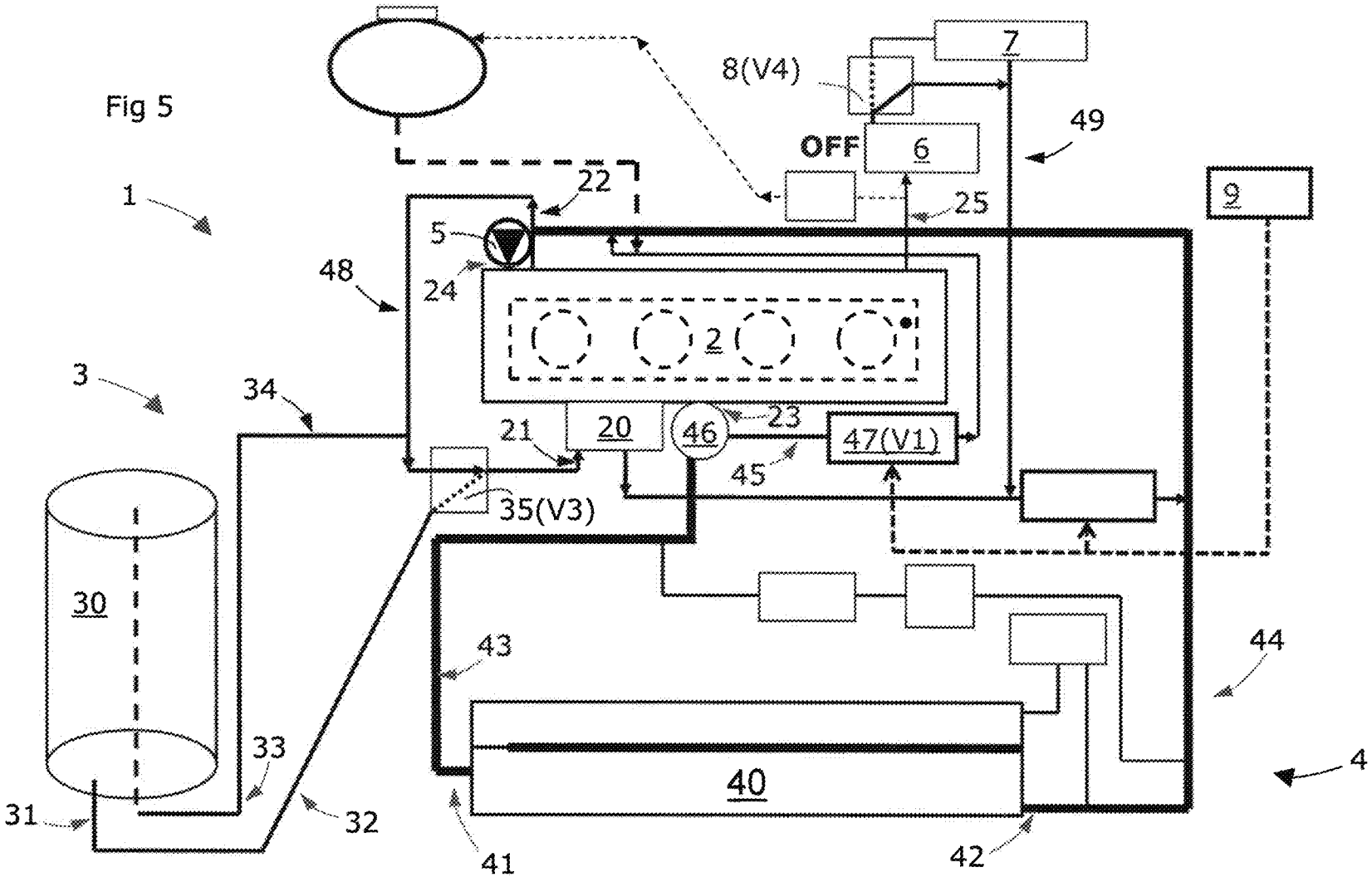
FIG. 5 shows the heating and cooling system of FIGS. 1 to 4 when the charging of the heat storage container has been completed and valves for bypass and heater/oil cooler are opened, wherein during this phase the thermostat is flushed with hot coolant from the engine, and the coolant temperature is so high that the thermostat will soon open for initiating flow of coolant to a radiator system of the vehicle for cooling of the coolant during normal operation of the engine and vehicle.
Figure 6:
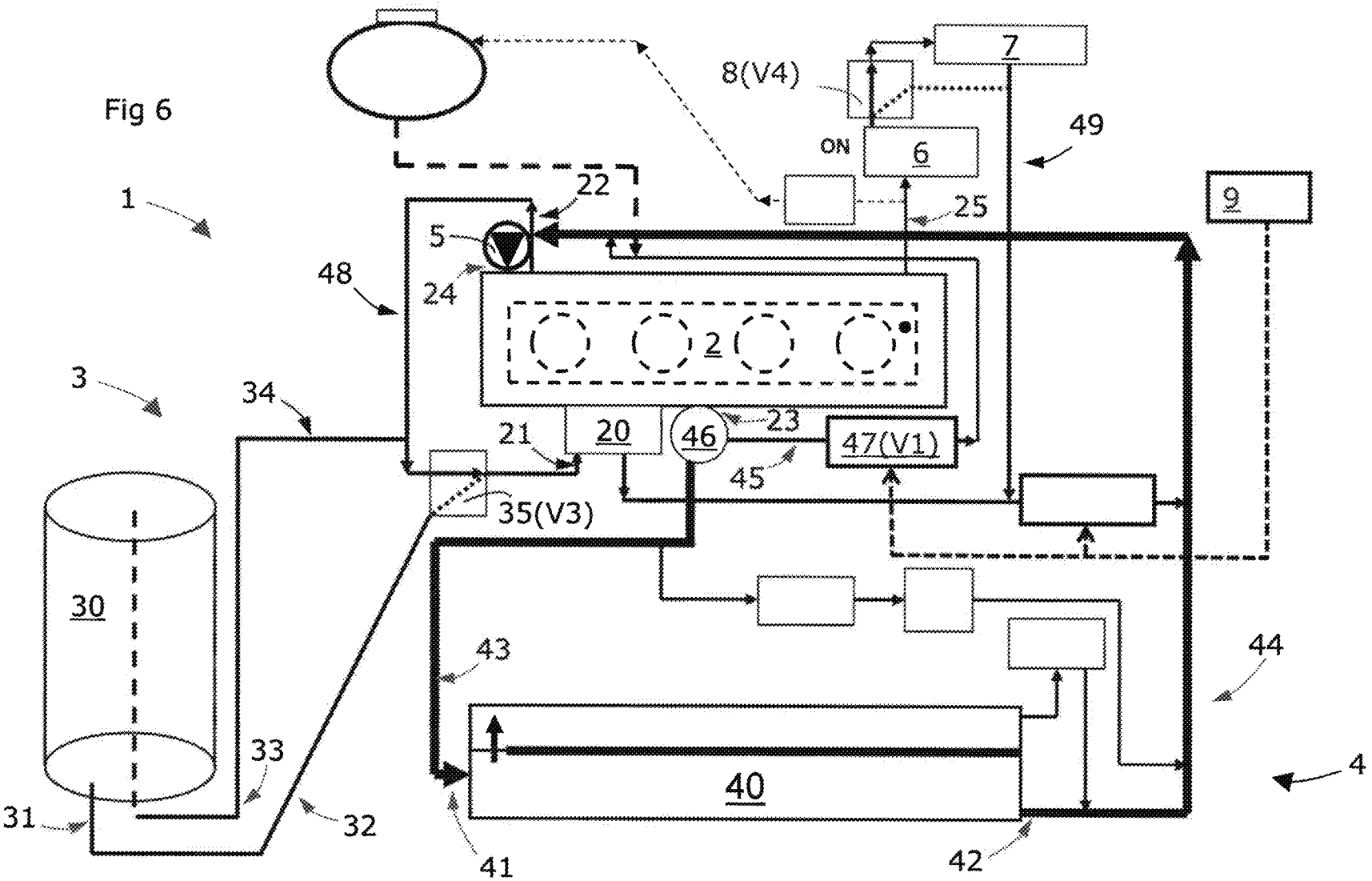
FIG. 6 shows the heating and cooling system of FIGS. 1 to 5 when the thermostat has opened as a direct effect of opening the bypass valve in the previous stage (FIG. 5), and the flow of coolant to the radiator system is or is on the way to becoming larger/"normal" during normal operation of the engine and vehicle.

FIG. 5 shows a subsequent scenario of the warm-up procedure of the engine 2 in FIGS. 1 to 4. The heat storage container 30 as a thermos is fully charged, and the temperature in the cooling system 1 is high. The first three-way valve 35 is closed. A second three-way valve 8 could open if requested, i.e., if cabin heating is requested. The shutoff valve 47 is opened, and circulation around the thermostat controlled valve 46 starts. Hence, as coolant temperature is high, the thermostat controlled valve 46 will open or starts to open to provide proper cooling by means of the radiator circuit 4.

FIG. 6 shows a subsequent scenario of the warm-up procedure of the engine 2 in FIGS. 1 to 5. The temperature in the cooling system is high. The first three-way valve 35 is still closed. Here, the optional second three-way valve 8 may open/be opened, if cabin heating is requested. The shutoff valve 47 is still open, and circulation around the thermostat controlled valve 46 has continued and it has opened more or even fully opened to provide maximum cooling by means of the radiator circuit 4. The radiator 40 may then also be fully operating, e.g., with flow through any supercooler and any charge air cooler (CAC), if the radiator comprises such components If the ambient temperature outside and/or within the vehicle is high, e.g., above 20° C., during warm-up of the engine 2, cabin heating is not requested from start of engine warm-up and the following exemplifying procedures are done for control of the warm-up of the engine 2 without using the cabin heater 7 of the vehicle.

A first condition is discharge of hot coolant from the heat storage container 30 for warm-up of the engine 2. The engine 2 is started with coolant temperature less than 60° C. (<60° C.) and the third gear of the vehicle transmission may be in operation to avoid involuntary start if only short parking maneuvers are performed.

The following control actions are performed:

1. shut-off valve 47 is closed.
2. first three-way valve 35 is activated to allow coolant flow through the heat storage container.
3. first electrical coolant pump 6 is started.

A second condition is when coolant temperature into the heat storage container 30 is higher than the temperature in the heat storage container or out from the heat storage container (temperature into heat storage container>temperature in heat storage container/out from heat storage container). These temperatures are measured or modeled.

The following control actions are performed:

1. shut-off valve 47 is still closed.
2. first three-way valve 35 is activated to bypass flow through the heat storage container 30.
3. first electrical coolant pump 6 is stopped.

A third condition is when recharge of the heat storage container 30 is performed, i.e., when target coolant temperature for recharge is reached.

The following control actions are performed:

1. shut-off valve 47 is still closed.
2. first three-way valve 35 is activated to allow coolant flow through heat storage container 30.
3. first electrical coolant pump 6 is started.

A fourth condition is a thermostat control when target coolant temperature is reached again after recharge of the heat storage container 30.

The following control actions are performed:

1. first three-way valve 35 is activated to stop flow through the heat storage container.
2. first electrical coolant pump 6 is stopped.
3. shut-off valve 47 is opened, and the thermostat controlled valve 46 is flushed with hot coolant to start opening to provide cooling of coolant through the radiator circuit 4 during "normal" operation of the engine.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A heating and cooling system for an internal combustion engine comprising:

a heat storage circuit including a heat storage container in which engine coolant is storable and into which and out of engine coolant is allowed to flow, the heat storage container having a container inlet connectable to a first coolant outlet of the engine, and a container outlet connectable to a first coolant inlet of the engine;

a radiator circuit including a radiator for flow of the engine coolant, the radiator having a radiator inlet and a radiator outlet, the radiator inlet being connectable via an upstream radiator conduit to a second coolant outlet of the engine, and the radiator outlet being connectable via a downstream radiator conduit to a second coolant inlet of the engine;

a bypass conduit connected between the upstream radiator conduit and the downstream radiator conduit and adapted to allow coolant to bypass the radiator;

a thermostat controlled valve arrangeable in the upstream radiator conduit at the second coolant outlet and connected to the bypass conduit, the thermostat controlled valve being adapted to direct coolant flow to the radiator and/or to the bypass conduit;

a shut-off valve arranged in the bypass conduit, wherein the shut-off valve is configured to cut off any engine coolant flow through the bypass conduit until the heat storage container is recharged with engine coolant of a predetermined temperature; and a pump having an inlet connectable to a third coolant outlet of the engine, and wherein coolant flow through the heat storage circuit is controllable by the pump.

2. The heating and cooling system according to claim 1 wherein the shut-off valve is adapted to open for engine coolant flow through the bypass conduit to cause the thermostat controlled valve to open when the engine coolant has a temperature being equal to or greater than the predetermined temperature.

3. The heating and cooling system according to claim 1 wherein the shut-off valve is adapted to cut off any engine coolant flow through the bypass conduit until a predetermined charge temperature of the heat storage container is reached, the predetermined charge temperature being higher than an opening temperature of the thermostat controlled valve.

4. The heating and cooling system according to claim 1 wherein the thermostat controlled valve comprises a thermostat housing through which coolant may flow, and the shut-off valve is adapted to cut off coolant flow through the thermostat housing when the shut-off valve is closed.

5. The heating and cooling system according to claim 1 further comprising a re-circulation conduit positioned between the first coolant inlet of the engine and the first coolant outlet of the engine, wherein the container outlet of the heat storage container is connected to the first coolant inlet of the engine via the re-circulation conduit.

6. The heating and cooling system according to claim 5 further comprising a three-way valve connected to the first coolant outlet of the engine, wherein the re-circulation conduit is connected to a first outlet port of the three-way valve, and the container inlet of the heat storage container is connected to a second outlet port of the three-way valve.

7. The heating and cooling system according to claim 5 wherein the re-circulation conduit is configured to enable coolant to flow from the first coolant outlet of the engine to the first coolant inlet of the engine.

8. The heating and cooling system according to claim 1 wherein the shut-off valve is configured to cut off any engine coolant flow through the thermostat controlled valve until the heat storage container is recharged with engine coolant of the predetermined temperature, so that no engine coolant flows through the radiator until the heat storage container is recharged with engine coolant of the predetermined temperature.

9. A method of controlling a heating and cooling system for an internal combustion engine, wherein the heating and cooling system includes a heat storage circuit and a radiator circuit, the heat storage circuit including a heat storage container in which engine coolant is storable and into which and out of engine coolant is allowed to flow, the heat storage container having a container inlet connected to a first coolant outlet of the engine, and a container outlet connected to a first coolant inlet of the engine, and wherein the radiator circuit includes a radiator for flow of the engine coolant, the radiator including a radiator inlet connected via an upstream radiator conduit to a second coolant outlet of the engine, and a radiator outlet connected via a downstream radiator conduit to a second coolant inlet of the engine, the radiator circuit further including a bypass conduit connected between the upstream radiator conduit and the downstream radiator conduit for allowing coolant to bypass the radiator, and a thermostat controlled valve arranged in the upstream radiator conduit at the second coolant outlet and connected to the bypass conduit, the thermostat controlled valve being adapted to direct coolant flow to the radiator and/or to the bypass conduit, and wherein the heating and cooling system includes a pump having an inlet connected to a third coolant outlet of the engine, and the method further comprises controlling coolant flow through the heat storage circuit by the pump, the method comprising:

controlling any engine coolant flow through the bypass conduit and the thermostat controlled valve by a shut-off valve arranged in the bypass conduit, wherein controlling any engine coolant flow through the bypass conduit and the thermostat controlled valve comprises cutting off, by the shut-off valve, any engine coolant flow through the bypass conduit until the heat storage container is recharged with engine coolant of a predetermined temperature.

10. The method according to claim 9 wherein controlling any engine coolant flow through the bypass conduit and the thermostat controlled valve comprises opening the shut-off valve for engine coolant flow through the bypass conduit, such that the thermostat controlled valve opens, when the engine coolant has reached a temperature being equal to or greater than the predetermined temperature.

11. The method according to claim 9 wherein controlling any engine coolant flow through the bypass conduit and the thermostat controlled valve comprises cutting off, by the shut-off valve, any engine coolant flow through the bypass conduit until a predetermined charge temperature of the heat storage container is reached, the predetermined charge temperature being higher than an opening temperature of the thermostat controlled valve.

12. The method according to claim 9 wherein the thermostat controlled valve comprises a thermostat housing through which coolant may flow, and the shut-off valve is operable to cut off coolant flow through the thermostat housing when the shut-off valve is closed.

13. A combination comprising:

an internal combustion engine having first and second coolant inlets and first and second coolant outlets; and a heating and cooling system including:

a heat storage circuit including a heat storage container in which engine coolant is stored and allowed to flow into and out of, the heat storage container having a container inlet connected to the first coolant outlet of the engine, and a container outlet connected to the first coolant inlet of the engine;

a radiator circuit including a radiator for flow of the engine coolant, the radiator having a radiator inlet and a radiator outlet, the radiator inlet being connected via an upstream radiator conduit to the second coolant outlet of the engine, and the radiator outlet being connected via a downstream radiator conduit to the second coolant inlet of the engine;

a bypass conduit connected between the upstream radiator conduit and the downstream radiator conduit and adapted to allow coolant to bypass the radiator;

a thermostat controlled valve arranged in the upstream radiator conduit at the second coolant outlet and connected to the bypass conduit, the thermostat controlled valve being adapted to direct coolant flow to the radiator and/or to the bypass conduit; and a shut-off valve arranged in the bypass conduit; and a pump having an inlet connected to a third coolant outlet of the engine, and wherein coolant flow through the heat storage circuit is controlled by the pump.

14. The combination according to claim 13 wherein the shut-off valve is adapted to cut off any engine coolant flow through the bypass conduit until the heat storage container is recharged with engine coolant of a predetermined temperature.

15. The combination according to claim 13 wherein the shut-off valve is adapted to open for engine coolant flow through the bypass conduit to cause the thermostat controlled valve to open when the engine coolant has a temperature being equal to or greater than a predetermined temperature.

16. The combination according to claim 13 wherein the shut-off valve is adapted to cut off any engine coolant flow through the bypass conduit until a predetermined charge temperature of the heat storage container is reached, the predetermined charge temperature being higher than an opening temperature of the thermostat controlled valve.

17. The combination according to claim 13 wherein the upstream radiator conduit is not connected directly to the first coolant outlet of the engine, so that the first radiator inlet is not able to receive coolant from the first coolant outlet of the engine before that coolant is returned to the engine.

18. The combination according to claim 13 further comprising a re-circulation conduit positioned between the first coolant inlet of the engine and the first coolant outlet of the engine, and a three-way valve connected to the first coolant outlet of the engine, wherein the re-circulation conduit is connected to a first outlet port of the three-way valve, the container inlet of the heat storage container is connected to a second outlet port of the three-way valve and the container outlet of the heat storage container is connected to the first coolant inlet of the engine via the re-circulation conduit.

* * * * *